US005813589A

United States Patent [19]

Kim

[11] Patent Number: 5,813,589

[45] Date of Patent: Sep. 29, 1998

[54] TAG PIN ATTACHER

[76] Inventor: Choon-Sun Kim, 999-10, Shinjung 4-Dong-Yangchon-Gu, Seoul, Rep. of Korea

[21] Appl. No.: 798,909

[22] Filed: Feb. 12, 1997

Related U.S. Application Data

[62] Division of Ser. No. 527,578, Sep. 13, 1995, Pat. No. 5,639,006.

[51] Int. Cl.[6] ..... B65C 7/00

[52] U.S. Cl. ..... 227/67

[58] Field of Search ..... 227/67, 71

[56] References Cited

U.S. PATENT DOCUMENTS

| | | | |
|---|---|---|---|
| 3,924,788 | 12/1975 | Furutu . | |
| 4,461,417 | 7/1984 | Furutsu . | |
| 4,485,954 | 12/1984 | Furutsu . | |
| 4,553,688 | 11/1985 | Furutsu . | |
| 4,819,855 | 4/1989 | Satoh et al. . | |
| 4,969,589 | 11/1990 | Kim . | |
| 5,074,452 | 12/1991 | Bone . | |
| 5,152,445 | 10/1992 | Furutsu | 227/67 |
| 5,398,859 | 3/1995 | Lee | 227/67 |
| 5,471,727 | 12/1995 | Kubota | 227/67 |

*Primary Examiner*—Scott A. Smith
*Attorney, Agent, or Firm*—Bryan Cave LLP

[57] ABSTRACT

A tag pin attacher has a casing including a space which is defined by a vertical wall and has a protrusion at a central part thereof, two horizontal walls formed perpendicular to the vertical wall, and a horizontal guide formed between the horizontal walls; a tag pin feed mechanism including an elevating plate which is received in the space and slides along the protrusion, the elevating plate having a cam groove, a rocking lever having a pin at a lower part thereof pivotally supported to the elevating plate, and a finger member horizontally interconnected to the rocking lever; an extrusion mechanism including an arm which abuts the rocking lever to turn the rocking lever, a cam member which is engaged with the cam groove of the elevating plate to move the elevating plate up and down, an interconnector having a yoke formed at a forward part thereof, the yoke abutting against the finger member to push the finger member forward, and a slider which is disposed within the interconnector and slides between the horizontal walls together with the interconnector; and a trigger mechanism including a trigger and a lever having a slot formed at a leading edge portion thereof for pivotally supporting the slider to interconnect the slider according to a movement of the trigger.

2 Claims, 8 Drawing Sheets

TAG PIN ATTACHER

This is a divisional of U.S. application Ser. No. 08/527,578, filed Sep. 13, 1995, now U.S. Pat. No. 5,639,006.

BACKGROUND OF THE INVENTION

1. Field of the Invention

This invention relates to a tag pin attacher, and, more particularly, to a tag pin attacher which can be used to attach tag pins to apparel, shoes, etc. without regard to the length or the diameter of a needle of the tag pin attacher and which can be charged with a string of tag pins of a narrow pitch.

2. Description of the Prior Art

A tag pin attacher is used to attach a tag pin T shown in FIG. 8A to apparel or shoes, etc. (collectively "apparel") A tag pin T consists of a head H by which a tag (not shown) is suspended, a rod R extended from the head H, and an anchor S formed at an end of the rod perpendicular thereto. FIG. 8B illustrates a string of tag pins formed by injection molding, which includes a plurality of tag pins integrally formed on a base D with cutting portions C bridging the tag pins and the base.

A tag pin attacher has a hollow needle for inserting the tag pins into the apparel. A user penetrates an object of apparel with the hollow needle via a hole provided on a tag and pulls a trigger on the tag pin attacher to suspend the tag from the apparel by the tag pin. That is, by pulling the trigger, the anchor S of the tag pin T is extruded through the hollow needle, and the object and the tag become interposed between the anchor S and the head H of the tag pin T. The cutting portion C of the tag pin T is cut by a cutter provided on the hollow needle while the anchor S is extruded through the hollow needle, thus separating the tag pin from the base D.

A conventional tag pin attacher for suspending a tag pin from an object as described above includes a charge mechanism for feeding, pitch by pitch, the tag pin to a position where the tag pin is extruded by hooking and pulling the tag pin at the cutting part C, an extrusion mechanism for axially pushing the anchor of the tag pin and for extruding the same through the hollow needle, and a trigger mechanism for operating the extrusion mechanism.

Conventional feed mechanisms are divided into sprocket types and hook types.

U.S. Pat. No. 4,969,589, issued to the present, discloses a sprocket type feed mechanism which it has a simple structure by which the tag pins are fed well. However, in this device, the pitch of the sprocket must correspond to intervals of the tag pins arranged on the base.

As a result, a base of a limited length may only have a limited number of tag pins because, as illustrated in FIG. 8B, the tag pins are arranged on the base D and, thus, a limitation on of the length of the base D and the intervals of the tag pins restricts the number of tag pins on the base D.

While it is possible to form 80 to 100 numbers of tag pins on one base, the base of the string of tag pins for use in the sprocket type feed mechanism devices cannot exceed 50 normally so that the user must change the strings of tag pins frequently.

Hook type feed mechanisms are advantageous in that a tag pin attacher having this mechanism can be charged with a string of tag pins of narrow pitch.

Among the hook type feed mechanisms are those in which the tag pins are fed by a two-stepped movement, i.e., an upward-downward movement of the, and those in which the tag pins are fed by a four-stepped movement, i.e., a forward-downward-backward-upward movement of the hook. The former, the two-stepped, is advantageous in that it can be performed by a tag pin attacher having a simple structure. However, on occasion, the tag pin may be disengaged during downward movement of the hook. Accordingly, the latter, the four-stepped type, is desirable, but requiring complicated structure.

Also, a long and thick hollow needle of 1.1 mm diameter is used for a thick object such as pelt or thick woven fabric, and a short and fine hollow needle of 0.8 mm diameter is used for a soft and thin fabric such as silk. The stroke of the extrusion mechanism must be changed according to the length of the hollow needle, and conventional tag pin attachers are not equipped to handle this requirement. Hence, different tag pin attachers are required for needles of different lengths.

SUMMARY OF THE INVENTION

An object of the present invention is to provide a tag pin attacher having a simple structure, wherein the tag pins are fed by a four-stepped movement of the hook.

Another object of the present invention is to provide a tag pin attacher wherein the extrusion stroke can be adjusted for both long and thick hollow needles and short and fine hollow needles.

To accomplish these objects, according to the present invention, a rocking lever, a finger member horizontally connected to the rocking lever, and an elevating plate having a cam groove formed thereon for a vertical movement of the elevating plate are disposed within a casing of the tag pin attacher. When an interconnector is moved together with a slider which is interconnected to a lever operated by a trigger, an arm of the interconnector is abutted against the rocking lever to turn the rocking lever such that the finger member is retracted and, then, the elevating plate is moved upward as a cam member formed on the arm travels along the cam groove, thus performing a two-stepped backward and upward movement. Thereafter, as the interconnector strikes and pushes the finger member, the finger member is moved forward. Also, a latch protrudes into or retracts from a passage through which the interconnector slides to interfere with the slide which is moved with the interconnector such that a stroke of the slide can be adjusted.

BRIEF DESCRIPTION OF THE DRAWINGS

FIGS. 6A through 6C are views illustrating a tag pin attaching operation wherein: FIG. 6A shows an initial state of the operation; FIG. 6B shows a state when the finger member is retracted; and FIG. 6C shows a state immediately after a tag pin is extruded.

FIGS. 8A and 8B are views of a string of tag pins, wherein FIG. 8A is a front view thereof, and FIG. 8B is a side view thereof.

BRIEF DESCRIPTION OF THE PREFERRED EMBODIMENT

Preferred embodiments of the present invention will be explained below with reference to the accompanying drawings.

Figure 1:
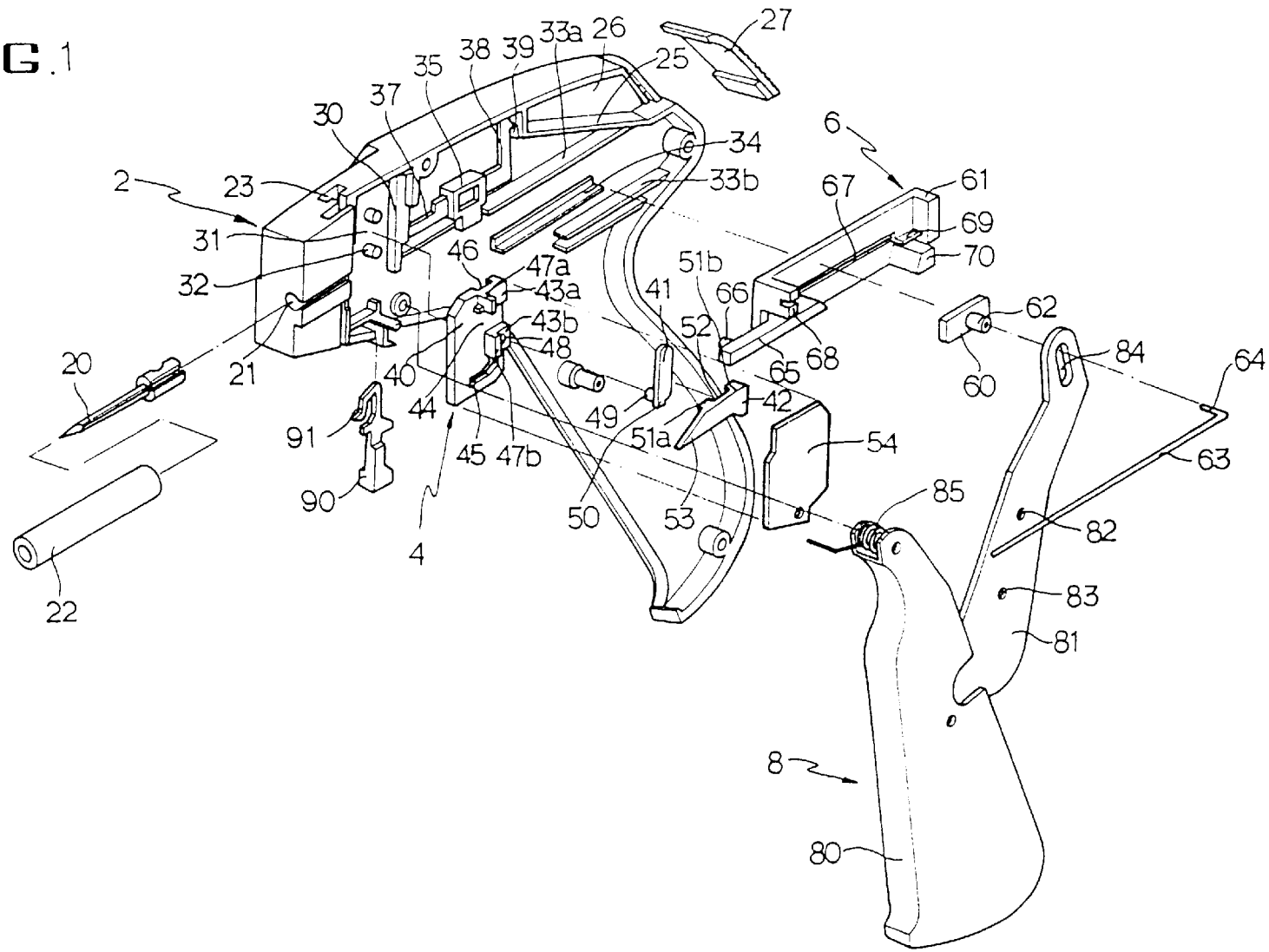
FIG. 1 is an exploded perspective view of a tag pin attacher according to the present invention.

In FIG. 1, reference numerals 2, 4, 6 and 8 denote a casing, a tag pin feed mechanism, an extrusion mechanism and a trigger mechanism, respectively. The tag pin feed mechanism 4, the extrusion mechanism 6 and the trigger mechanism 8 are received within the casing 2.

The casing 2, like a conventional tag pin attacher, has a hole 21 in front thereof, and a hollow needle 20 is inserted through the hole 21. Both the hollow needle 20 and the hole 21 have their walls open along their lengths as illustrated in FIG. 1, and a protector 22 is inserted over the hollow needle 20.

Figure 8A:
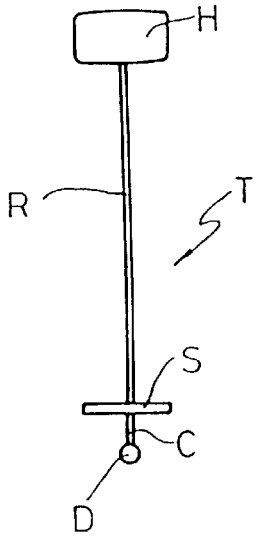
Figure 8B:
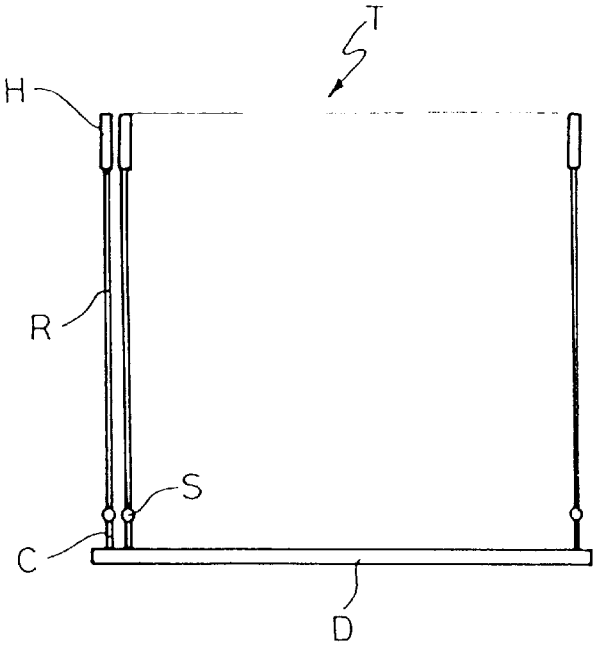

The casing 2 has a slot 23 formed at an upper face near the front end thereof, and the base D of the tag pin T illustrated in FIGS. 8A and 8B is inserted through the slot 23.

Figure 2:
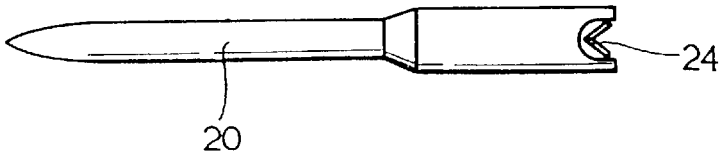
FIG. 2 is a rear view of a hollow needle adopted for the tag pin attacher of FIG. 1.

As shown in FIG. 2, the hollow needle 20 has a V-shaped cutting blade 24 at a stem portion thereof. The cutting blade 24 cuts the tag pins T at the cutting parts C thereof, shown in FIGS. 7A and 7B, thus making individual tag pins T separate from the string of tag pins.

The casing 2 has a vacancy 26 divided by a partition 25 at an upper rear portion thereof, and the hollow needle 20 and the protector 22 can be stored in the vacancy 26 which is capped by a lid 27. The vacancy 26 is adequate for storing the hollow needle 20, and the protector 22 is stored in the vacancy when the tag pin attacher is in use.

Figure 3:
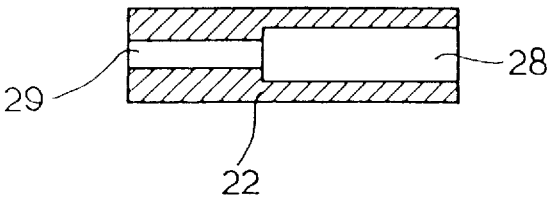
FIG. 3 is a side cross sectional view of a protector for covering the hollow needle of FIG. 2.

As shown in FIG. 3, the protector 22 has an axial bore which consists of a large diameter section 28 and a small diameter section 29. A long and thick hollow needle can be inserted into the large diameter section 28 and a short and fine hollow needle can be inserted into the small diameter section 29 to protect the needles.

A vertical wall 30 is provided inside the casing 2 at a front portion thereof to define a space 31 which has two protrusions 32 vertically formed at a central part thereof.

Two horizontal walls 33*a* and 33*b* extending in a direction perpendicular to the vertical wall 30 are formed inside the casing 2 at a rear portion thereof.

A horizontal guide 34 is formed between the horizontal walls 33*a* and 33*b*.

Figure 4:
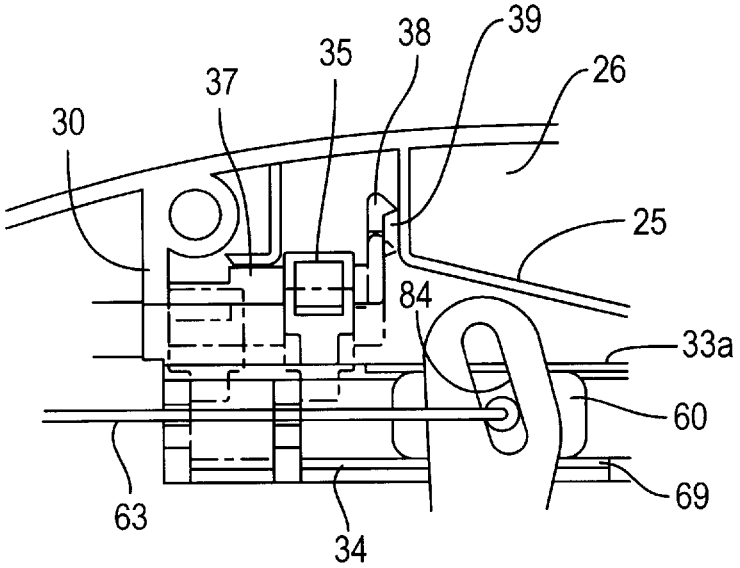
FIG. 4 is a partial side view illustrating a latch adopted for the tag pin attacher of FIG. 1.

A latch 35 is provided inside the casing 2 adjacent to the upper horizontal wall 33*a*. As shown in chained line in FIG. 4, the latch 35 can slide on a bar 37 which is moved up and down by a knob 36 that is provided outside the casing and that is attached to bar 37 through an opening in the casing. As the knob 36 is moved, the lower end of latch 35 becomes positioned over the upper horizontal wall 33*a*.

To make the knob 36 operated between two certain points, a gripper 38 is formed at a rear end of the bar 37. This gripper 38 rides over a ridge 39 formed on the partition 25 and performs a clicking movement when the knob 36 is operated.

A tag pin feed mechanism 4 includes an elevating plate 40, a rocking lever 41, and a finger member 42, and the elevating plate 40, being guided by the vertical wall 30 and the protrusions 32, is moved up and down within the space 31. The elevating plate 40 has a guide channel 44 defined by a pair of guide walls 43*a* and 43*b* formed on a side thereof, a cam groove 45 formed on the same side, and a sliding groove 46 vertically formed on the other side. The guide walls 43*a* and 43*b* have stoppers 47*a* and 47*b*, respectively, and a pin hole 48 is formed at a center of the lower guide wall 43*b*.

The rocking lever 41 has a pin 49 formed in a direction perpendicular thereto, and the pin 49 is inserted in the pin hole 48. Also, a protuberance 50 is formed at a lower end of the rocking lever 41. The rocking lever 41 is pivotally installed on the elevating plate 40, and when the rocking lever 41 is abutted against the stoppers 47*a* and 47*b*, it is in a vertical position.

The finger member 42 has a pair of projections 51*a* and 51*b* defining an inclined groove 52 in which the rocking lever 41 is inserted. The finger member 42 at its front has a paw 53 for hooking and pulling down the cutting part C of the tag pin of FIG. 8B. As the rocking lever 41 pivots about the pin 49, the finger member 42 performs a reciprocating motion.

A cover 54 is used to secure each component and to maintain them assembled to each other.

Figure 5:
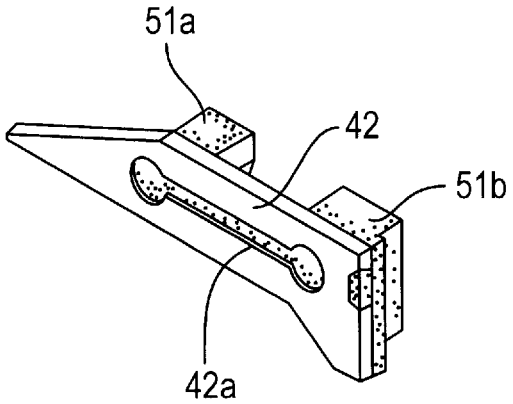
FIG. 5 is a perspective view illustrating a finger member which can be adopted for the tag pin attacher of FIG. 1.

The finger member 42 can be integrally formed by injection molding or, as shown in FIG. 5, can be formed of a metal plate having a hole 42*a* of adequate shape formed therein, and the projections 51*a* and 51*b* can be made of synthetic resin and formed by injection molding. The finger member 42 made of metal has a good resistance to wear and thus has a long service life.

The extrusion mechanism 6 has a slider 60 with an interconnector 61 moved by the slider 60.

The slider 60 has a journal 62 formed on a side thereof, and a rear end 64 of an extrusion rod 63 is connected to the journal 62.

The interconnector 61 has an arm 65 formed on a front part thereof and a channel 67 formed along the length thereof, and a cam member 66 is formed on a leading end of the arm 65 on a side thereof. The channel 67 is inserted over a horizontal guide 34 formed on the casing 2, and the movement of the interconnector 61 is guided thereby. The cam member 66 of the arm 65 is engaged with the cam groove 45 of the elevating plate 40 to move the elevating plate 40 up and down.

The interconnector 61 has a yoke 68 and a limiter 69 formed in front and back of the channel 67, respectively. The yoke 68 guides forward and rear ward movement of the extrusion rod 63, strikes the finger member 42 at the end of the forward stroke of the interconnector 61, and, together with the limiter 69 opposed to the yoke 68, defines the range of the stroke of the slide 60.

A projecting portion 70 is formed on a lower end of the interconnector 61 at a predetermined distance from a rear end of the arm 65.

The trigger mechanism 8 has a trigger 80 and a lever 81 having an end pivoted on the trigger 80. The lever 81 has two hinge holes 82 and 83 located at a middle and a lower end thereof, respectively, and one slot 84 at an upper end thereof. The middle hinge hole 82 is hinged on the casing 2, the lower hinge hole 83 is hinged on the trigger 80 by a pin etc., and the trigger 80 is hinged on the casing 2 with a return spring 85 interposed therebetween.

Figure 6A:
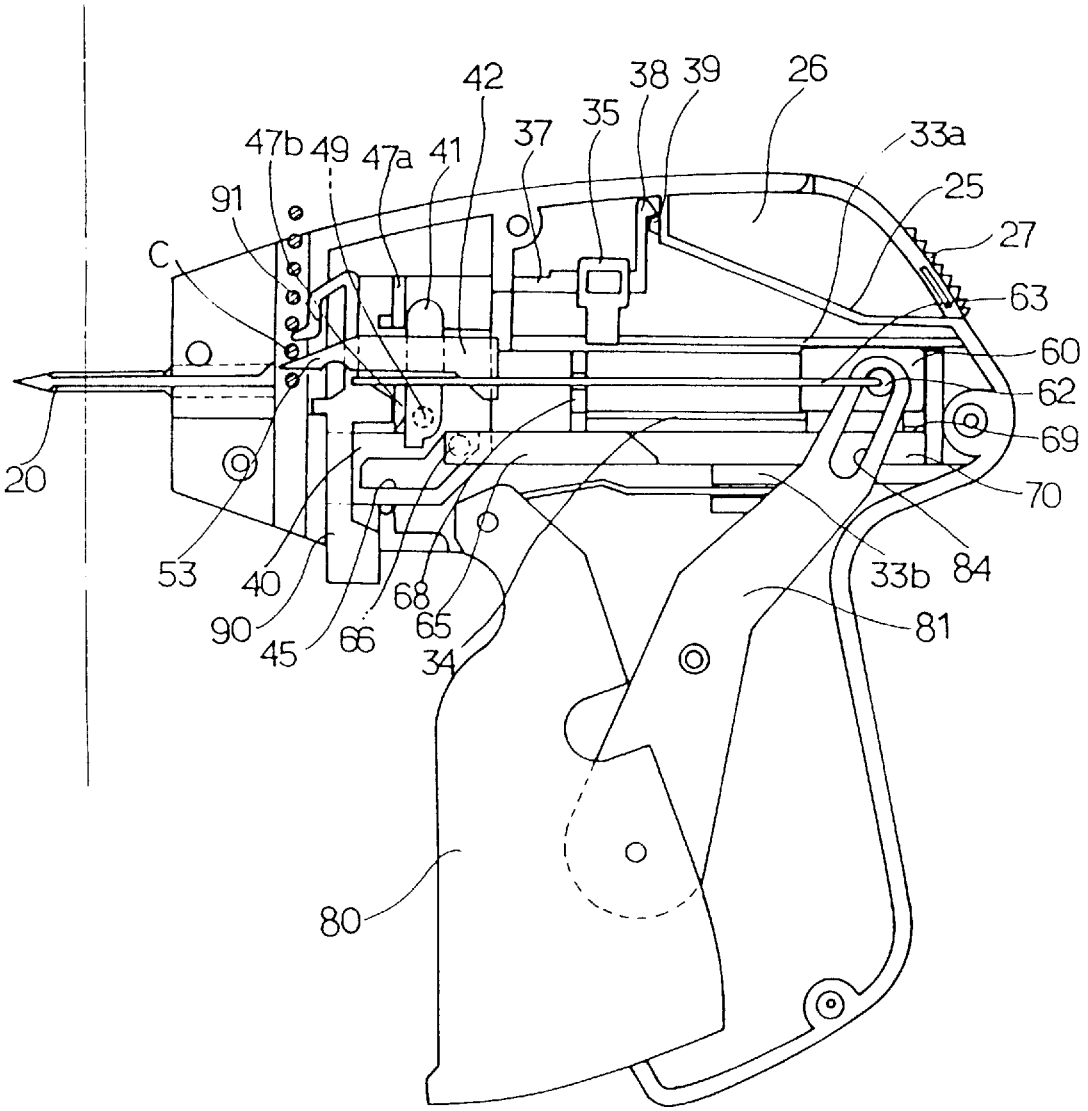

A checker 90 having an elastic hook 91 is disposed below the slot 23 in the casing 2. As shown in FIG. 6A, the checker 90 is engaged with the cutting part C of the tag pin T charged in the slot 23. When the user pushes up the checker 90, the elastic hook 91 is bent to release the cutting part C of the tag pin T, and, then, the tag pin T can be removed from the slot 23.

Figure 6B:
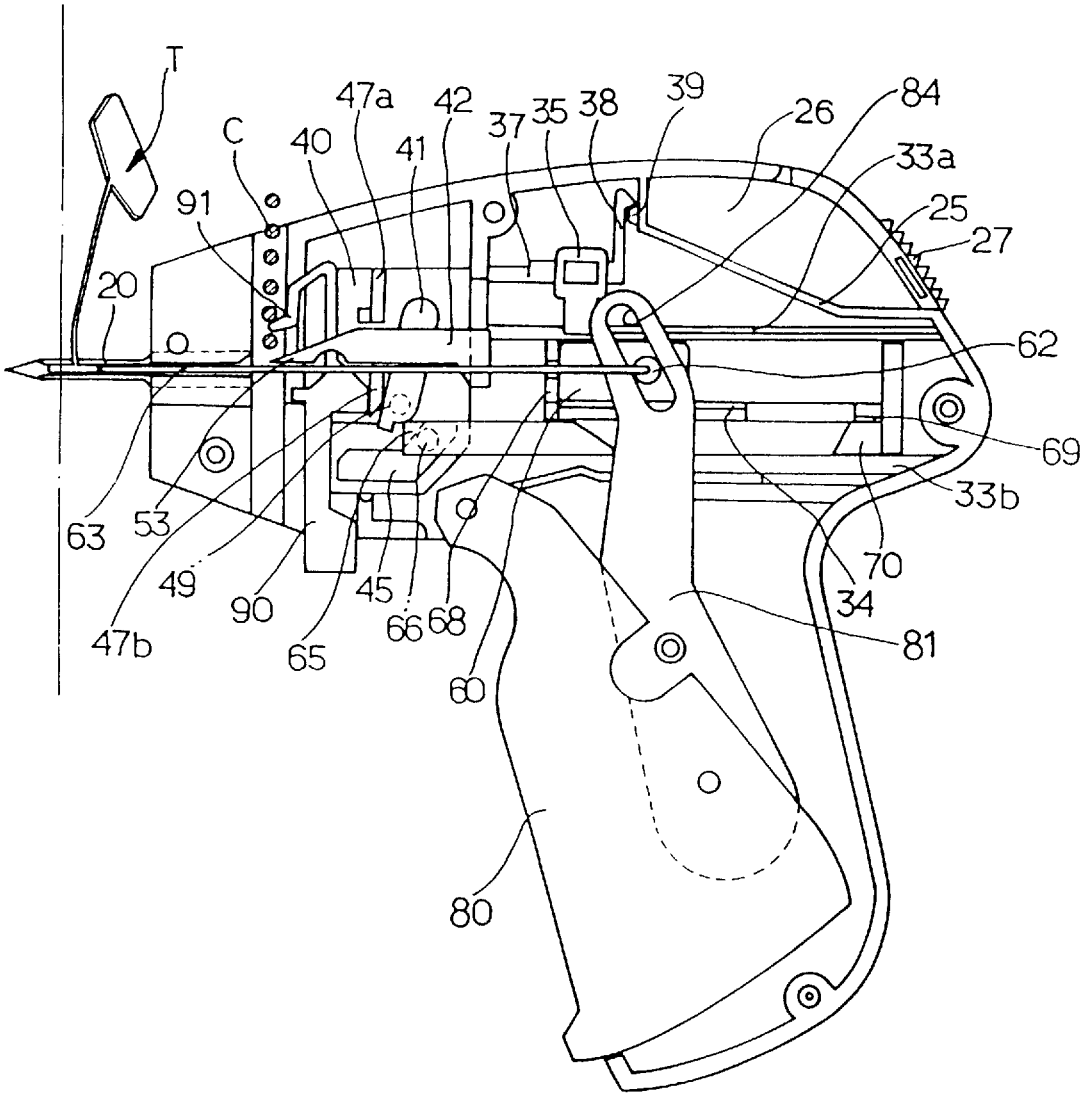
Figure 6C:
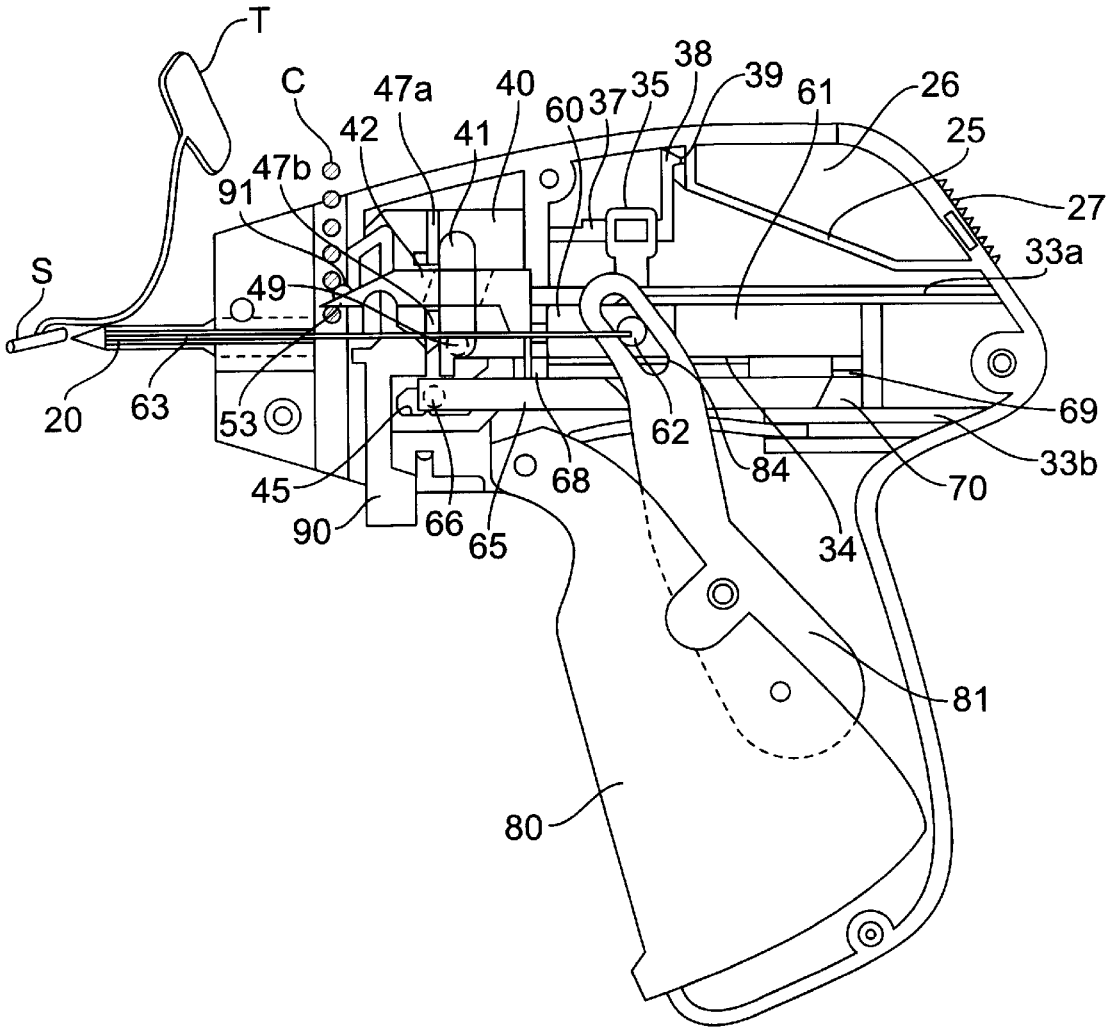

The extrusion process of the tag pins T by the tag pin attacher having the aforementioned structure is illustrated in FIGS. 6A through 6C.

At an initial state of the operation shown in FIG. 6A, the paw 53 of the finger member 42 is engaged with the cutting part C of the first tag pin to pull down and maintain the same at an extrusion position. At this moment, the elevating plate 40 is located at a low position, and, therefore, the cam member 66 of the interconnector 61 is located at an upper end of the cam groove 45 and the rocking lever 41 is in its vertical position.

When the user pulls the trigger 80 as shown in FIG. 6B, the lever 81 moves the slider 60. As the slider 60 abuts against the yoke 68 and pushes the yoke 68 of the interconnector 61 forward, the arm 65 extended toward the front of the yoke 68 pushes the protuberance 50 formed at the lower end of the rocking lever 41 to turn the rocking lever 41 clockwise such that the finger member 42 is retreated and released from the engagement with the cutting part C of the tag pin T, and the cam member 66 simultaneously travels along a path defined by the cam groove 45 to push up the elevating plate 40. At this state, the extrusion rod 63 is positioned about halfway along its travel through the hollow needle 20 such that the tag pin T is almost extruded through the hollow needle 20.

In the meantime, the interconnector 61 continues to proceed, the elevating plate 40 is moved up to a high position by the cam member 66 moving to a low position in the cam groove 45, and, consequently, the finger member 42 is moved up to a level where it can be engaged with the second tag pin.

As the trigger 80 is pulled further, the slider 60 pushes the interconnector 61 to the left end as shown in FIG. 6C, and the cam member 66 of the interconnector 61 proceeds to the low position in the cam groove 45. Accordingly, the elevating plate 40 does not move while the rear end of the finger member 42 is struck by the yoke 68 of the interconnector 61 and the paw 53 of the finger member 42 is engaged with the cutting part C of the second tag pin. In the meantime, the extrusion rod 63 completely penetrates the hollow needle and extrudes the tag pin T.

After the hollow needle 20 penetrates the object on which the tag is to be attached, the tag pin T is extruded through the hollow needle 20 and becomes suspended from the object.

When released by the user, the trigger 80 is returned to its original position under the action of the return spring 85.

In the return process, as the lever 81 pivots about the middle hinge hole 82, the slider 60 interconnected with the lever 81 is moved backward immediately while the interconnector 61 is not moved until the lever 81 contacts the projecting part 70. Thus, the finger member 42 is not moved until the extrusion rod 63 is completely out of the hollow needle 20 and passes below the paw 53 of the finger member 42 such that the extrusion rod 63 may not interfere with the next tag pin. Even though the interconnector 61 remains in contact with the rear end of the finger member 42 until the next tag pin is pulled down, the interconnector 61 is in a free state, not pushed by the slider 60, such that slipping may occur between the finger member 42 and the cutting part C of the tag pin T. Accordingly, it is necessary to apply oil of high viscosity such as grease between the guide walls 43*a* and 43*b* which guide the finger member 42 so that the rocking lever 41 or the finger member 42 may not slip backward.

As the lever 81 abuts against and pushes the projecting portion 70 backwards, the cam member 66 moving through the cam groove 45 lowers the elevating plate 40, and the finger member 42 pulls the next tag pin down to the extrusion position to complete one cycle of operation.

Figure 7A:
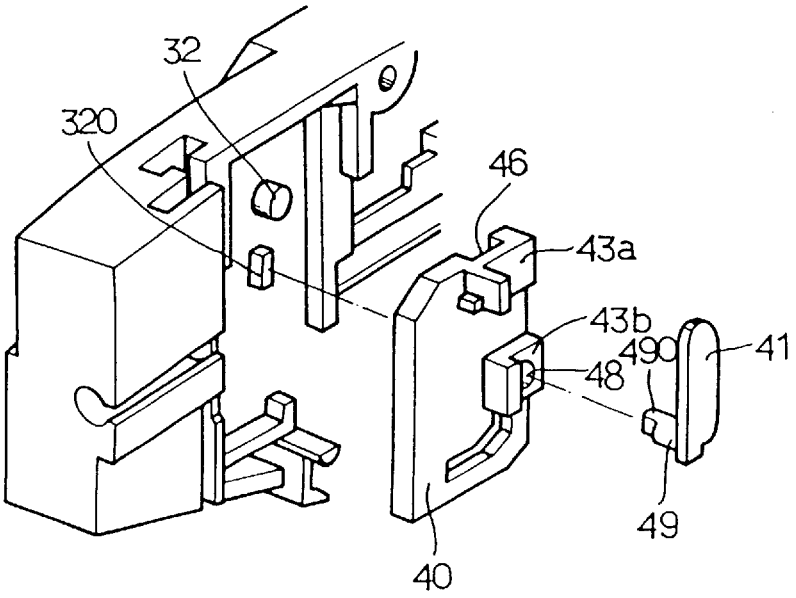
FIG. 7A is an exploded perspective view illustrating an embodiment of a structure for mounting a rocking lever different from that shown in FIG. 1.
Figure 7B:
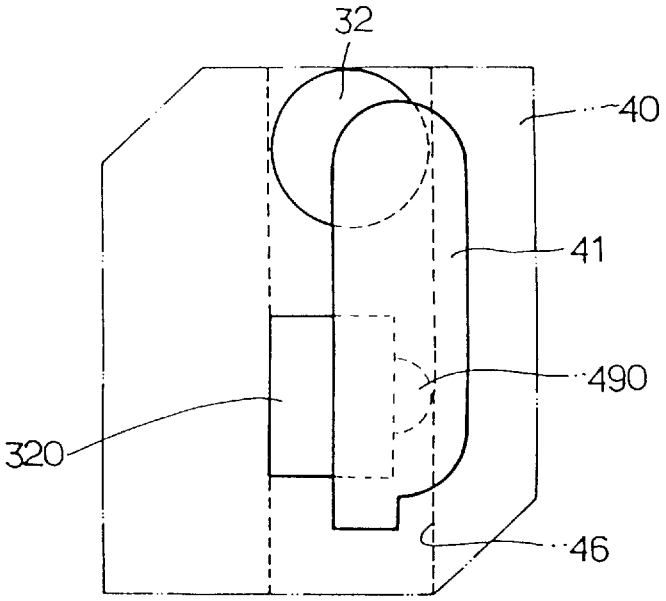
FIG. 7B is a view showing the components of FIG. 7A assembled.

FIG. 7A illustrates another embodiment of a structure for mounting the rocking lever 41. This structure here has a protrusion 320 having a rectangular cross section and the pin 49 of the rocking lever 41 has a lower end 490 having a semicircular cross section. The rocking lever 41 is assembled to the elevating plate 40 with its lower end 490 penetrating through the pin hole 48 of the lower guide wall 43*b* on one side of the elevating plate 40 and protruding through the sliding groove 46 on the other side of the elevating plate 40. Referring to FIG. 7B, as a result, a flat face of the lower end 490 abuts against a flat face of the protrusion 320 and guided thereby such that the rocking lever 41 remains upright.

In this embodiment, because the rocking lever 41 does not move with respect to the elevating plate 40, the finger member 42 does not slip backward from the cutting part C of the tag pin T and the loading of the tag pin is ensured thereby while the elevating plate 40 is pulled down.

One aspect of the present invention makes it possible to adjust the stroke of the slider 60 in two stages.

Before the initial state of the operation shown in FIG. 6A, the user can shift the knob 36 to insert the latch 35 between the upper horizontal wall 33*a* and the yoke 68 of the interconnector 61. When the slider 60 is moved forward, the latch 35 is pushed by the slider 60 and slides along the bar 37. This makes the stroke of the slider 60 short which is adequate for a short and fine hollow needle. The stroke of the slider 60 without intervention of the latch 35 is long, which is adequate for a long and thick hollow needle.

When the interconnector 61 is moved back, the latch 35 is pushed by the interconnector 61 and slides back along the bar 37.

As described above, a simple combination of the elevating plate, rocking lever, and the finger member in the present invention produces a four-stepped movement of the finger member which makes it possible to extrude the tag pin accurately regardless to the pitch of the tag pins in a string. Also, the stroke of the slider can be adjusted in two stages such that two kinds of hollow needles can be used in one tag pin attacher.

Furthermore, it is easy to change the design of the tag pin attacher itself because it is enough to change the cam groove formed on the elevating plate according to the pitch of the tag pins in the string.

What is claimed is:

1. A tag pin attacher comprising:

an interconnector (61) having a yoke (68) and slider (60) slidably disposed therein, the slider (60) being interconnected to a lever (81);

a casing (2) having upper and lower horizontal walls (33*a* 33*b*) formed therein, the slider (60) being slidably disposed between the upper and lower horizontal walls (33*a* 33*b*); and a latch (35) sliding on a bar (37) disposed adjacent to and in front of the upper horizontal wall (33*a*), the latch (35) being interconnected to a knob (361) disposed out of the casing (2) and protruding between the upper horizontal wall (33*a*) and the yoke (68) of the interconnector (61) for adjusting a stroke of the slider (60) within the interconnector (61) thereby.

2. The tag pin attacher as claimed in claim 1 wherein the bar (37) has a gripper (38) at a rear end thereof, the gripper (38) riding over a bridge (39) formed on the casing to give a clicking feeling when the knob (36) is operated.

* * * * *